US006719062B2

(12) United States Patent
Fikes et al.

(10) Patent No.: US 6,719,062 B2
(45) Date of Patent: Apr. 13, 2004

(54) CT DRILLING RIG

(75) Inventors: Mark W. Fikes, Duncan, OK (US); Mark Farabee, Houston, TX (US); E. Alan Coats, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/345,629

(22) Filed: Jan. 16, 2003

(65) Prior Publication Data

US 2003/0106695 A1 Jun. 12, 2003

Related U.S. Application Data

(62) Division of application No. 09/739,072, filed on Dec. 15, 2000.

(51) Int. Cl.[7] ..... E21B 19/22
(52) U.S. Cl. ..... 166/379; 166/77.1; 166/85.1
(58) Field of Search ..... 166/329, 380, 166/386, 77.1, 85.1, 85.4, 77.51; 175/85

(56) References Cited

U.S. PATENT DOCUMENTS

| | | | | |
|---|---|---|---|---|
| 2,974,760 A | | 3/1961 | Woolslayer et al. | 189/11 |
| 3,878,662 A | | 4/1975 | Cernosek | 52/745 |
| 3,942,593 A | | 3/1976 | Reeves, Jr. et al. | 173/23 |
| 4,135,340 A | | 1/1979 | Cox et al. | 52/115 |
| 4,178,632 A | | 12/1979 | Anthony | 364/513 |
| 4,215,848 A | | 8/1980 | van de Werken | 254/107 |
| 4,345,864 A | * | 8/1982 | Smith, Jr. et al. | 414/22 |
| 4,645,084 A | | 2/1987 | Deike | 212/271 |
| 4,899,832 A | | 2/1990 | Bierscheid, Jr. | 173/23 |
| 5,407,302 A | | 4/1995 | Springett et al. | 405/196 |
| 5,454,533 A | | 10/1995 | Grant et al. | 244/134 |
| 5,704,427 A | | 1/1998 | Buck et al. | 166/338 |
| 5,816,736 A | | 10/1998 | Kroulik | 403/389 |
| 5,850,874 A | | 12/1998 | Burge et al. | 166/77.3 |
| 5,908,122 A | | 6/1999 | Robinett et al. | 212/275 |
| 6,000,480 A | | 12/1999 | Eik | 175/8 |
| 6,045,297 A | | 4/2000 | Voorhees et al. | 405/303 |
| 6,161,358 A | | 12/2000 | Mochizuki et al. | 52/651.05 |
| 6,408,955 B2 | * | 6/2002 | Gipson | 175/57 |
| 2003/0102166 A1 | * | 6/2003 | Jortveit | 175/162 |

* cited by examiner

*Primary Examiner*—William Neuder
(74) *Attorney, Agent, or Firm*—Conley Rose, P.C.

(57) ABSTRACT

A drilling rig includes a tower, a stabilizer for lifting/lowering an injector and BOP stack, and a powered arm adapted to manipulate BHA segments. The tower includes a plurality of interlocking modules and is mounted on two perpendicularly aligned skids. The tower is also provided with an opening that enables the side loading of equipment. The preferred rig includes one module adapted to support a stabilizer that includes hydraulic lifts that can raise the injector and BOP stack off the wellhead. The stabilizer also accommodates the thermal expansion of the BOP stack by rising and lowering the stack during well servicing operations. The powered arm attaches to the tower and includes an articulated gripper for manipulating the bottom hole assembly segments. Preferably, the powered arm is controlled by a general-purpose computer that guides the powered arm through a predetermined sweep.

14 Claims, 12 Drawing Sheets

CT DRILLING RIG

CROSS-REFERENCE TO RELATED APPLICATIONS

The present application is a divisional of U.S. patent application Ser. No. 09/739,072 filed Dec. 15, 2000 and entitled "CT Drilling Rig", which relates U.S. patent application Ser. No. 10/020,367, filed Dec. 12, 2001 and entitled "Self-Erecting Rig", which claims the benefit of 35 U.S.C. 119(e) U.S. provisional application Ser. No. 60/256,049, filed Dec. 15, 2000 and entitled "Self-Erecting Rig", all hereby incorporated herein by reference.

Not Applicable.

BACKGROUND OF THE INVENTION

1. Field of the Invention

The present invention generally relates to rigs for deploying bottom hole assemblies ("BHAs") that are connected to a flexible umbilical. More particularly, the present invention relates to transportable rigs for deploying multi-segment BHAs connected to composite coiled tubing. In another aspect, the present invention relates to methods for deploying BHAs connected to flexible umbilicals. In still another aspect, the present invention relates to methods of automating the deployment of BHAs connected to a flexible umbilical.

2. Description of the Related Art

Many existing wells include hydrocarbon pay zones that were bypassed during original drilling and completion operations. Well operators or owners chose not to complete these zones because these bypassed zones were not economical to complete and produce. That is, the expected recovery rate of hydrocarbons from a bypassed zone did not justify the cost of implementing the downhole equipment need to complete and produce the bypassed zone. For example, offshore drilling platforms can cost upwards of $40 million to build and may cost as much as $250,000 a day to lease. Such costs preclude the use of such expensive platforms to exploit hydrocarbon pay zones that may not produce hydrocarbons in sufficient quantity or rates to offset these costs. Thus, often only the larger oil and gas producing zones are completed and produced because those wells are sufficiently productive to justify the cost of drilling and completion using conventional offshore platforms. Similar economic considerations also come into play for land based wells. Because many major oil and gas fields are now paying out, there is need for a cost-effective method of producing these previously bypassed hydrocarbon pay zones.

Cost effective production of bypassed zones requires, in part, drilling and completion systems and methods that can efficiently reach these subterranean formations. Also required are surface support and control systems that can economically deploy these drilling and completion systems and methods.

The system and methods disclosed in commonly-owned U.S. application Ser. No. 09/081,961, entitled "Well System," filed on May 20, 1998, now U.S. Pat. No. 6,296,066, which is hereby incorporated herein by reference for all purposes, addressed the first need. One embodiment of a system disclosed in the "Well System" application for economically drilling and completing the bypassed pay zones in existing wells includes a bottom hole assembly disposed on a composite umbilical (hereinafter a "CCT BHA") made up of a tubing having a portion thereof which is preferably non-metallic.

Referring to FIG. 1, there is shown a BHA 10 disposed in a lateral borehole 12 branching from a primary wellbore 14. BHA 10 is operatively connected to a composite coiled tubing umbilical 16 and may include a drill bit and other modules or segments. BHA segments may include a gamma ray and inclinometer and azimuth instrument package, a propulsion system with steerable assembly, an electronics section, a resistivity tool, a transmission, and a power section for rotating the bit.

Because composite tubulars are much lighter and more flexible than steel pipe and steel coiled tubing, the operational reach of a drill or working string formed of composite coiled tubing 16 is significantly increased for at least two reasons. One reason is that the relative lightweight nature of composite coiled tubing lessens the power required of downhole tractors and other transport systems.

A closely related second reason is that composite tubing can be designed to be neutrally buoyant in drilling mud. In an ordinary case, high pressure drilling mud is pumped from the surface to the BHA 10 via the composite umbilical 16. The hydraulic pressure of the drilling mud is used to power the propulsion system and to rotate the drill bit. The drilling mud exits the BHA 10 through nozzles located on the drill bit. The exiting drilling mud cools the drill bit and flushes away the cuttings of earth and rock. Drilling mud returns to the surface via the annulus 19 defined by the wall 21 of lateral wellbore 12 and composite coiled tubing 16. The materials for composite tubing 16 and the drilling mud can be selected to achieve neutral buoyancy in the drilling mud in which the composite coiled tubing is immersed. Thus, downhole tools, such as propulsion systems, need only provide sufficient force to tow neutrally buoyant composite coiled tubing 16 through wellbore 12 and to plan a force on the drill bit.

The profitability of bypassed zones also depends, in part, on the costs associated with introducing, operating, and retrieving a drilling and completion system, such as a CCT BHA, at a given well site. Prior art drilling rigs have inherent drawbacks that reduce the cost effectiveness of using drilling and completion systems to construct new wells and workover existing wells. Some of these drawbacks are discussed below.

The prior art does not disclose rigs that may be readily moved from one well to another on a well site. For example, as is well known in the art, subterranean hydrocarbon fluids are typically under significant pressure. During drilling, this pressure must be controlled to prevent hydrocarbon fluids from surging up the wellbore and causing a "blow-out" at the surface. Blowout preventers are attached to the wellhead to control this well pressure. In order to contain this well pressure, it is important that the BOP's and related components making up the BOP stack be tightly sealed. Before a prior art drilling rig supporting a CCT BHA system can be moved from a first well to a second well at a given well site, the valves and other joints making up the BOP stack must be disassembled. These valves and joints must be reconnected and tested after the rig has been moved above the second well. Considerable time and effort may be saved if this disassembly procedure could be minimized. Thus, what is needed is a rig that provides for the movement of a BOP stack as an integral unit to minimize the time and costs associated with servicing multiple wells at a given well site.

The prior art also does not disclose rigs that are readily moved between well sites to support drilling and completion operations. Prior art rigs are generally not designed to be connected and disconnected at several successive well sites.

Thus, well construction or well workover often require a new rig to be constructed at each well site. What is needed is a rig that can be constructed at a given well site and then disassembled and moved to a second well site for re-use. Such a rig would minimize the need for additional rig superstructures.

The prior art also does not disclose a rig that effectively supports the introduction of a CCT BHA into a well. A CCT BHA designed in accordance with the above description may be over fifty feet in length. Because handling such a long BHA can be unwieldy, the many components making up the BHA are usually assembled into multiple BHA modules or segments. These BHA segments are in turn connected together to form a complete BHA. Such a procedure using prior art rigs is cumbersome because prior art rig do not provide means to mechanically manipulate and dispose successive BHA segments into a well. Thus, what is needed is a rig that facilitates the deployment of BHA segments into a well.

As can be seen, prior art rigs are not cost effective with respect to service multiple wells. Moreover, prior art rigs limit the economical use of CCT BHAs in servicing bypassed wells and also increase the cost of constructing new wells.

The present invention overcomes the deficiencies of the prior art.

SUMMARY OF THE INVENTION

The preferred embodiment of the present invention includes a modular rig fitted with a stabilizer for lifting/lowering an injector and BOP stack and a powered arm adapted to manipulate the BHA segments. The rig includes a tower made up of a plurality of interlocking modules. The tower is mounted on two perpendicularly aligned skids. In an exemplary deployment, the rig is initially assembled at a first well site with the skids preferably disposed such that the tower can be moved over at least two wells. After a first well is serviced, the tower is moved on the skids over to the second well. Once all wells at the first well site are serviced, the rig is disassembled into individual rig modules and moved to a second well site. Thus, an advantage of the present invention is that one rig may be deployed in several successive operations thereby minimizing the costs of constructing multiple rigs.

The preferred rig includes one module that is provided with an equipment skid to support the stabilizer. The stabilizer supports the injector and BOP stack. The stabilizer includes hydraulic lifts that can raise the injector and BOP stack off the wellhead. Thus, before the rig is moved on the skids from one well to another at a well site, the connection between the BOP stack and wellhead is disconnected. Thereafter, the stabilizer is actuated to lift the injector and BOP stack and the entire assembly is moved as one piece. The stabilizer also preferably accommodates the thermal expansion of the BOP stack by rising and lowering the work string and BHA during well servicing operations. Thus, an advantage of the present invention is that assembly time and costs for moving a BOP stack is minimized.

The powered arm is attached to the rig tower and includes an articulated gripper for manipulating the CCT BHA segments. Preferably, the powered arm is controlled by a general purpose computer that guides the powered arm through a predetermined sweep that begins with grasping a CCT BHA segment and ends with positioning the CCT BHA segment above the injector. Thus, an advantage of the present invention is that manual lifting and handling of CCT BHA segments is minimized.

Thus, the present invention comprises a combination of features and advantages which enable it to overcome various problems of prior devices. The various characteristics described above, as well as other features, will be readily apparent to those skilled in the art upon studying the following detailed description of the preferred embodiments of the invention, and by referring to the accompanying drawings.

DETAILED DESCRIPTION OF THE PREFERRED EMBODIMENT

A preferred embodiment of a rig made in accordance with the present invention may be used on a platform constructed to carry out hydrocarbon exploration and recovery operations either offshore or on land. The preferred rig facilitates the introduction of wirelines, a working string, a drill string, and other tubular umbilicals into a subterranean wellbore. The preferred rig also enables the efficient deployment and operation of bottom hole assemblies (BHAs). For simplicity, the present discussion will be directed to a preferred rig that is adapted to introduce a BHA that is operatively connected to composite coiled tubing, i.e., "CCT BHA".

Figure 2:
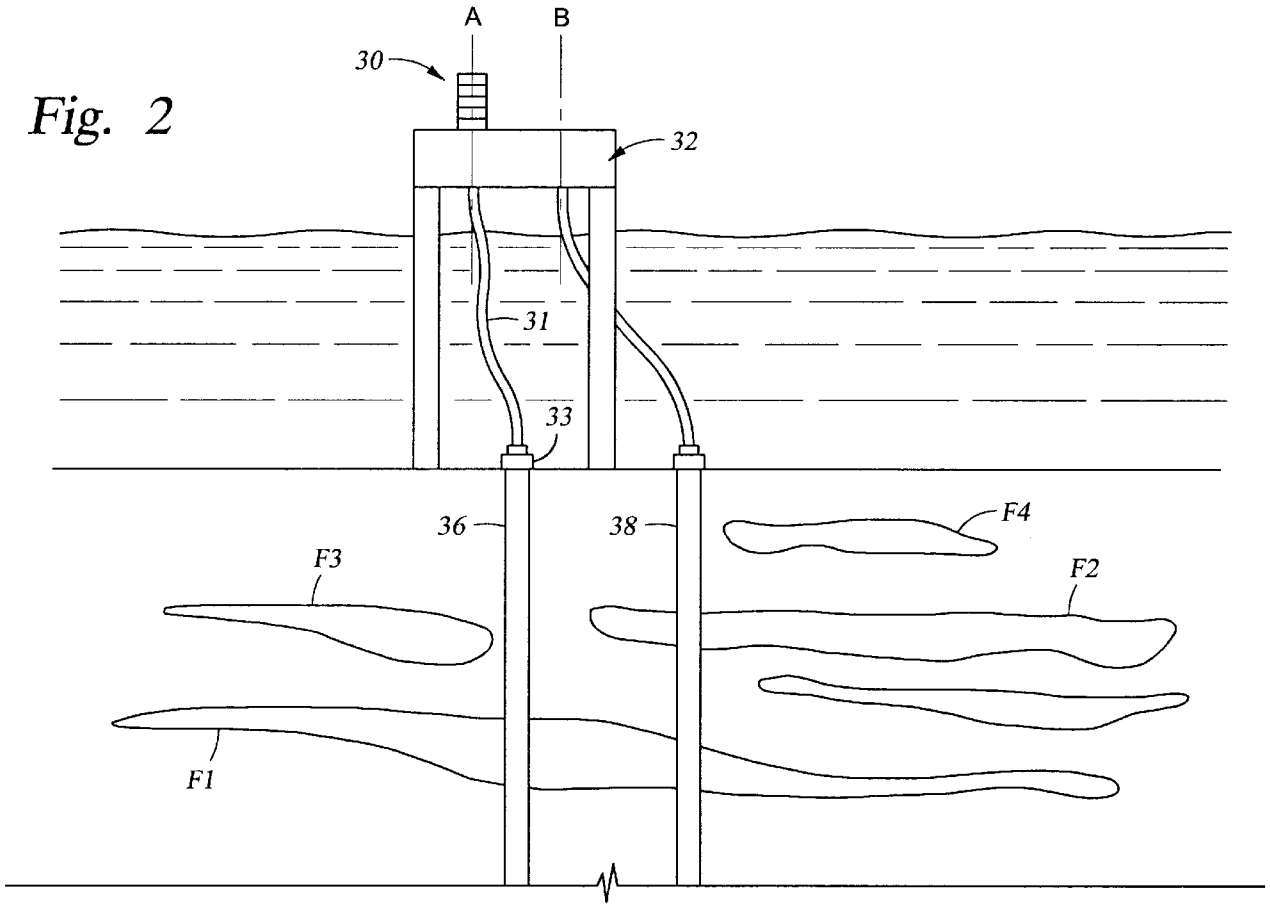
FIG. 2 illustrates a side view of a preferred embodiment of a rig deployed in an offshore environment.

Referring initially to FIG. 2, preferred rig 30 is shown on an offshore platform 32. A riser 31 extends from platform 32 to a subsea wellhead assembly 33. Hydrocarbon reservoirs collectively referred to as numeral 34 includes a formation F1 produced by well 36 and formation F2 produced by well 38. For clarity, not shown in FIG. 2 are the various equipment, facilities, and ancillary components typically found on well platforms. These items include generators, hydraulic pumps and hoses, generators and electrical cables, data transmission wires, living quarters, control rooms, mud pumps, storage facilities and other equipment components and facilities that are known to those of ordinary skill in the art.

Figure 3:
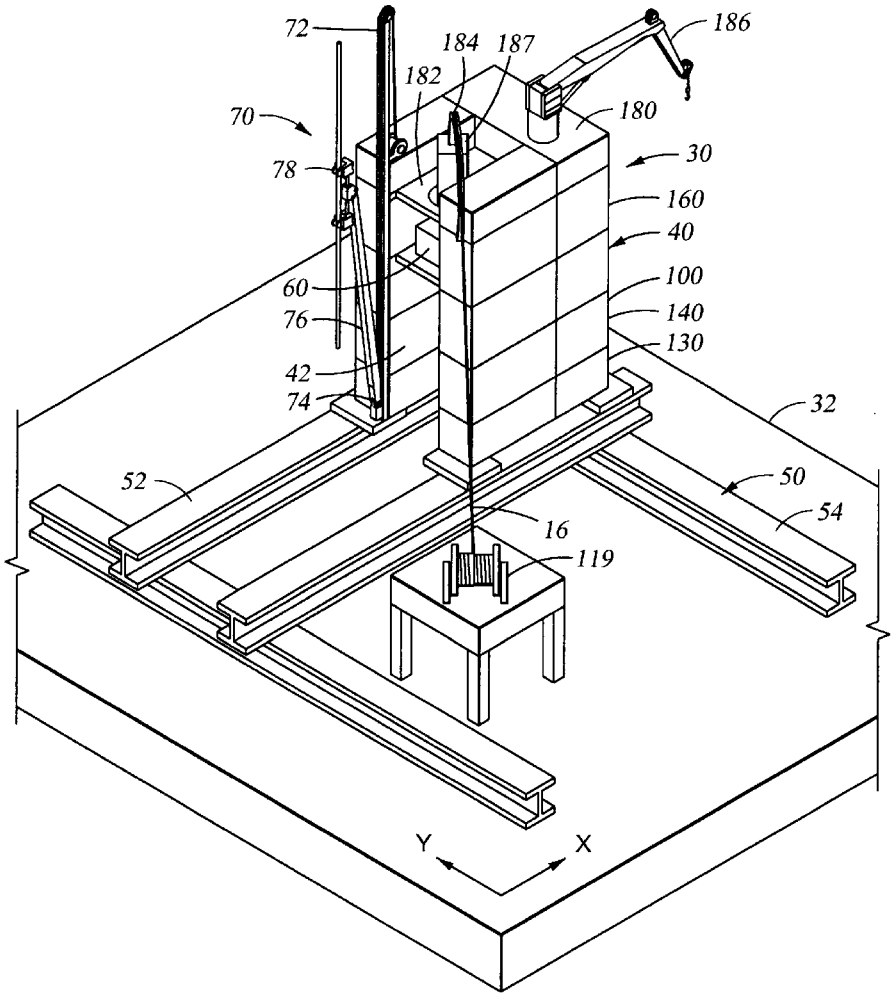
FIG. 3 illustrates an isometric view of a preferred rig disposed on a platform.

Referring now to FIG. 3, preferred rig 30 includes a tower 40, tower skids 50, an injector stabilizer 60 and a powered arm 70. Tower 40 is formed of a plurality of modules 100, including a base module 130, a plurality of intermediate modules 140, an injector module 160, and a crown module 180.

Figures 1, 4C:
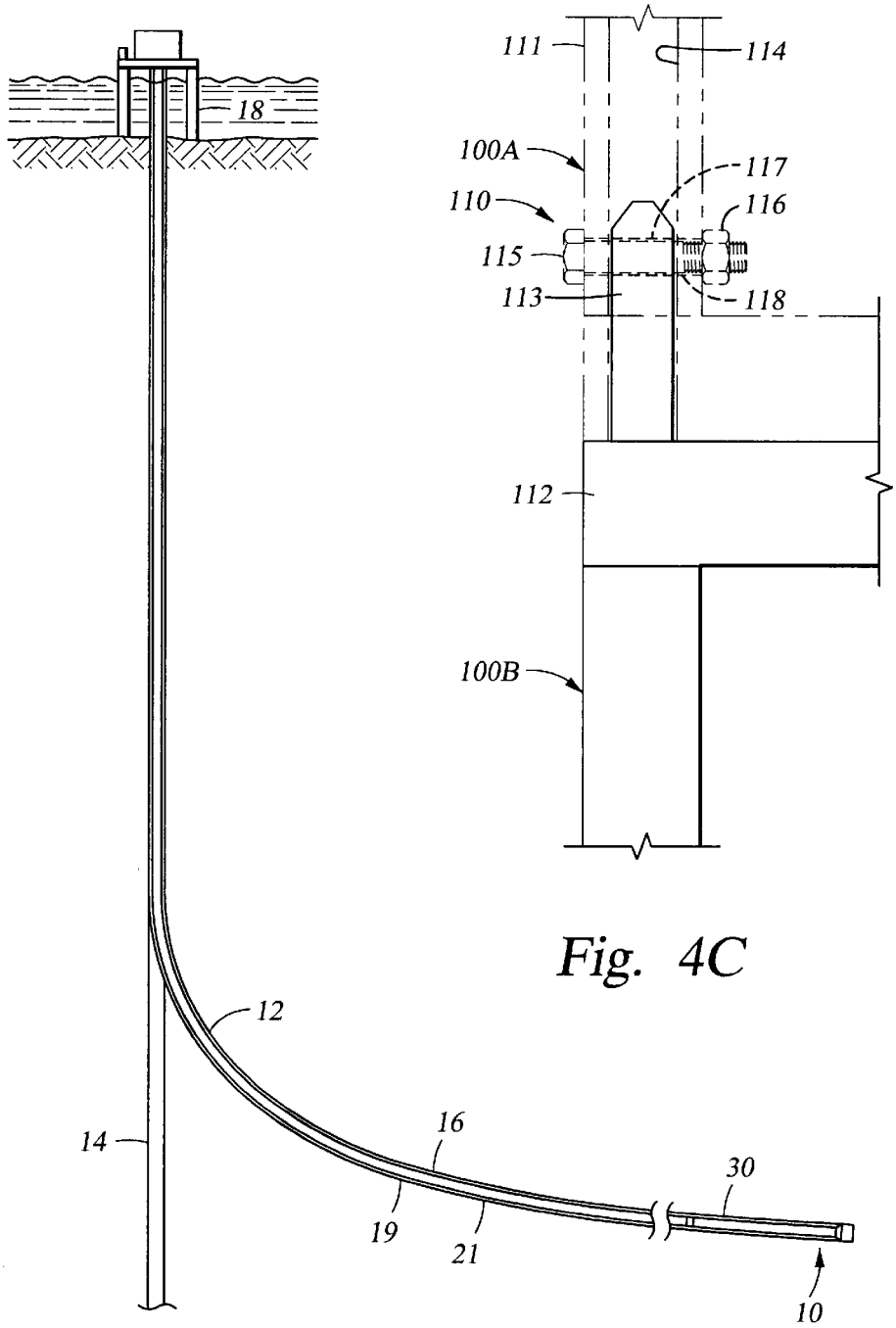
FIG. 1 illustrates a well bore being drilled by a CCT BHA that is operated from an offshore platform.
FIG. 4C illustrates a side view of connector connecting and locking an upper module, in phantom, with a lower module.
Figure 4A:
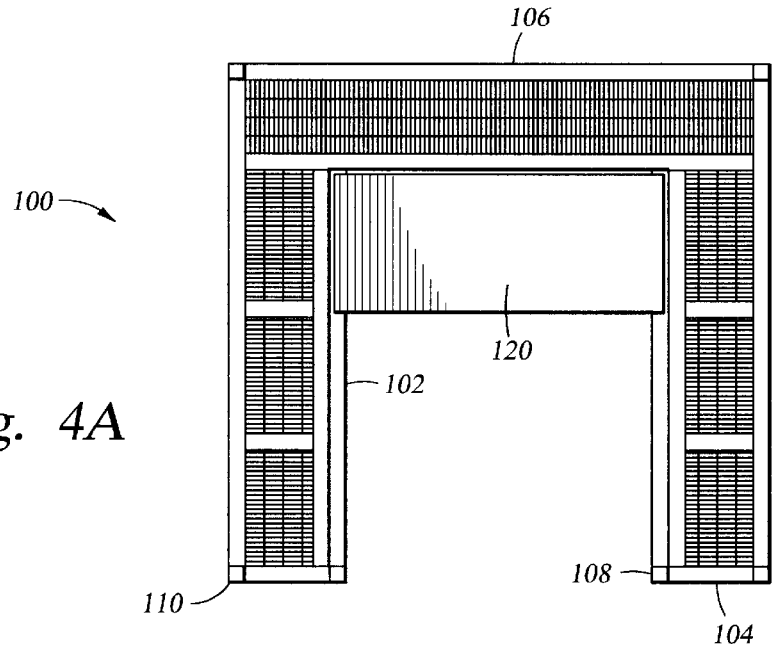
FIG. 4A illustrates a plan view of a preferred rig module with a module skid in the back position.

Referring now to FIG. 4A, modules 100 provide the skeletal superstructure to support rig equipment. Modules 100 are substantially rectangular forming a front face 104 and a back wall 106 and having a generally u-shaped cross-section forming an interior opening or throat 102. Throat 102 has an entry opening 108 in front face 104. Front face 104 has an opening 108 for accessing throat 102. Thus, modules have a generally "U" shaped configuration. Referring briefly again to FIG. 3, when stacked, module throats 102 define a vertical shaft 42 that is accessible through module front face 104 (FIG. 4A). Thus, it can be seen that tower 40 is provided with an "open" throat 102 that allows well equipment to be side loaded as well as top loaded.

Referring now to FIGS. 4A and 4C, each module 100 includes connectors 110 that provide a locking engagement between adjacent modules 100. A preferred connector 10 will be described with reference to an upper module 100*a* having a lower frame 111, (shown in phantom), and a lower module 100*b* having an upper frame 112. Connector 110 includes an upwardly projecting post 113, a bore 114 in frame 111, a locking pin 115 and a threaded nut 116. A first set of upwardly projecting posts 113 are disposed on upper frame 112 of lower module 100*b* and complementary set of bores 114 are provided in lower frame 111 of upper module 100*a*. Additionally, posts 113 and lower frame 111 include transverse holes 117, 118 adapted to accept locking pin 115. During assembly, bore 114 of an upper module 100*a* closely receives post 113 of adjoining lower module 100*b* such that post transverse hole 117 and lower frame transverse hole 118 align. Thereafter, locking pin 115 is inserted through aligned transverse holes 117, 118. Threaded nut 116 screws onto locking pin 115 and thereby locks upper and lower modules 100*a* and 100*b*.

Figure 4B:
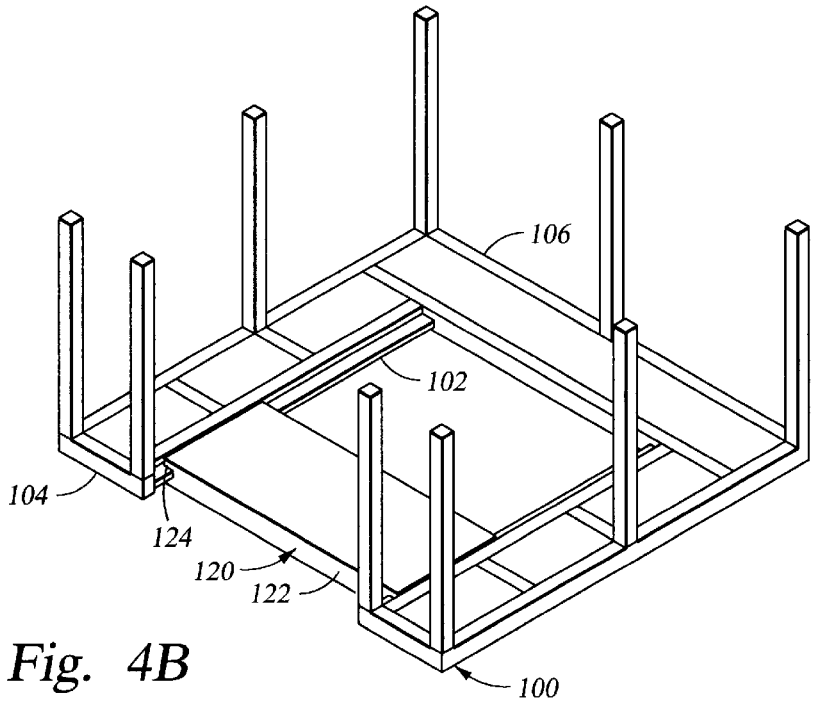
FIG. 4B illustrates an isometric cut-away view of a preferred rig module with a module skid in the front position.

Referring now to FIGS. 4A and 4B, modules 100 preferably include a skid 120 reciprocally disposed within throat 102. Module skid 120 allows well equipment suspended in tower shaft 42 (FIG. 3) to be moved along a plane transverse to the shaft axis. Preferably, skid 120 includes a pallet 122 and a tongue-in-groove arrangement 124. Tongue-in-groove arrangement 124 allows pallet 122 to slide between multiple positions proximate module front face 104 and module backwall 106. Thus, FIG. 4A depicts skid 120 in its rearward position adjacent backwall 106 (a back position) whereas FIG. 4B depicts skid 120 in its forward position adjacent front face 104 (a front position). It is expected that the rear position of FIG. 4B will be the normal position of skid 120 during well servicing operations. Motive power for skid 120 may be provided by a hydraulically powered ram arrangement, an electrically powered gear drive or other suitable drive system (not shown). Skid 120 may be operated locally through controls (not shown) provided on module 100 or remotely from a control room. Preferably, position sensors (not shown) are strategically located the along travel path of skid 120 to provide an indication of skid movement. Further, closed circuit video cameras installed on module 100 provide a visual indication of skid 120 or other well equipment in operation. Thus, position sensors and video cameras, which are in communication with control room monitors, provide well personnel with sufficient information to remotely conduct well operations.

Referring again to FIG. 3, injector 160, crown module 180, intermediate modules 140 and base module 130 are preferably adapted to support specific well equipment as discussed herein below.

Figure 5:
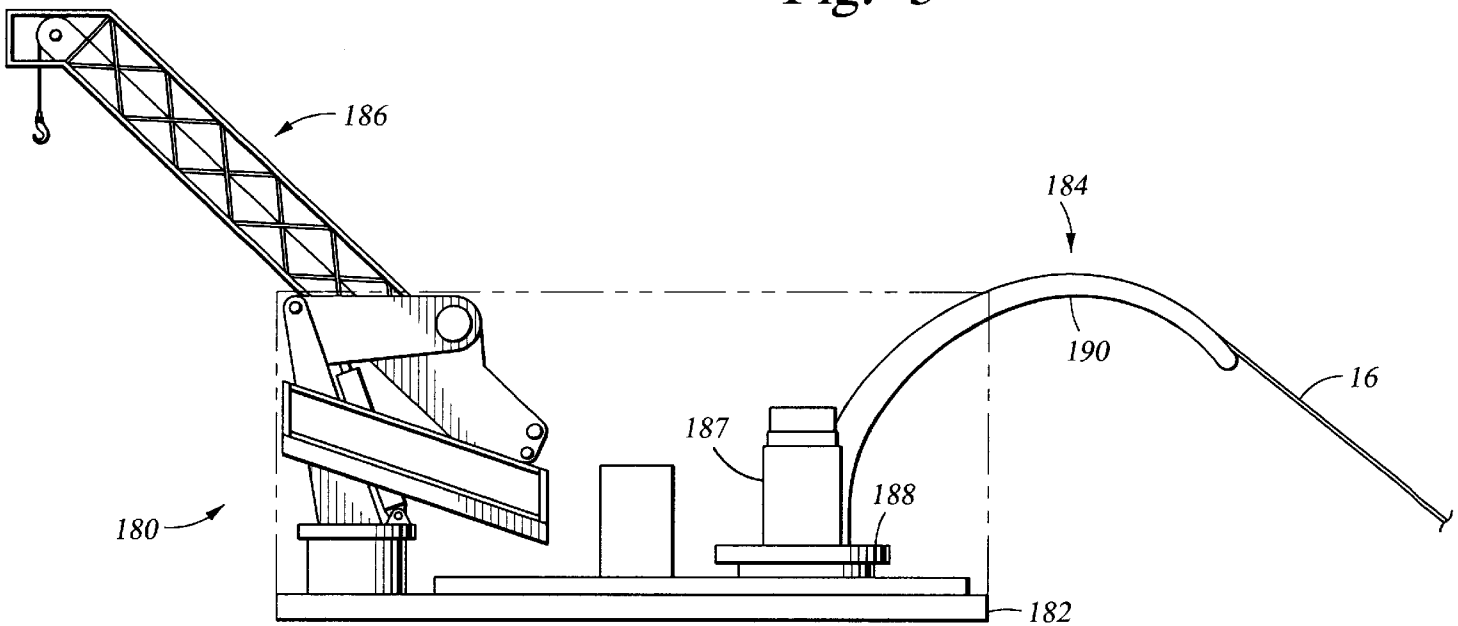
FIG. 5 illustrates an side view of a preferred crown module.

Referring now to FIG. 5, crown module 180 includes a skid 182 for supporting a coiled tubing guide 184. Crown module 180 is also preferably fitted with a knuckleboom crane 186 and a power tong assembly 187. Coiled tubing guide 184 directs coiled tubing 16 from the reel 119 (see FIG. 3) to the injector 162 (see FIG. 6). Coiled tubing guide 184 preferably includes a rotatable base 188 and a gooseneck 190 fixed thereon. Preferably, coiled tubing guide 184 mounts onto skid 182 of crown module 180 using a bowl-and-slip arrangement (not shown). As used in the petroleum industry, a bowl and slip assembly typically includes a support (bowl) having a frustoconical opening and sliding inner slips disposed within the opening. Base 188, when installed in the bowl, is gripped, and supported by the inner slips. The inner slips release their grip when the base 188 is lifted. Thus, base 188 can be set in a first angular position on crown module skid 180, and easily lifted and reoriented to a second angular position as operations require. The variable angular orientation of guide 184 allows greater flexibility in selecting a location on platform 32 for reel 119 shown on FIG. 3.

Power tong assembly 187 is mounted adjacent to coiled tubing guide 180 and allows for the make up of the CCT BHA 10. As is well known in the oil and gas industry, power tongs 187 can grip and rotate tubular members, such as drill pipe, using high compressive forces while applying a high torque in order to make up or break out threaded pipe connections. As discussed earlier, the BHA 10 may include a number of subassemblies, one or more of which may be connected using threaded joints. Preferably, consecutive BHA segments are made up just before their insertion into the injector. Power tongs may be used to mechanically rotate the joint of one of the BHA segments into threaded engagement with another adjacent, BHA segment. Slips or second set of power tongs may be used to hold one of the two BHA subassemblies stationary during the connection process.

Knuckleboom crane 186 provides rig a dedicated apparatus to lift and transport well equipment. Knuckleboom crane 186 is preferably positioned towards the rear of crown module 180. In the initial stages of constructing tower 40 (FIG. 3), the main platform crane (not shown) is used. However, once installed on crown module 180, knuckleboom crane 186 is used for lifting and handling to free the main platform crane for other uses. Thus, rig construction activities need not be based on the availability of the main platform crane.

Figure 6:
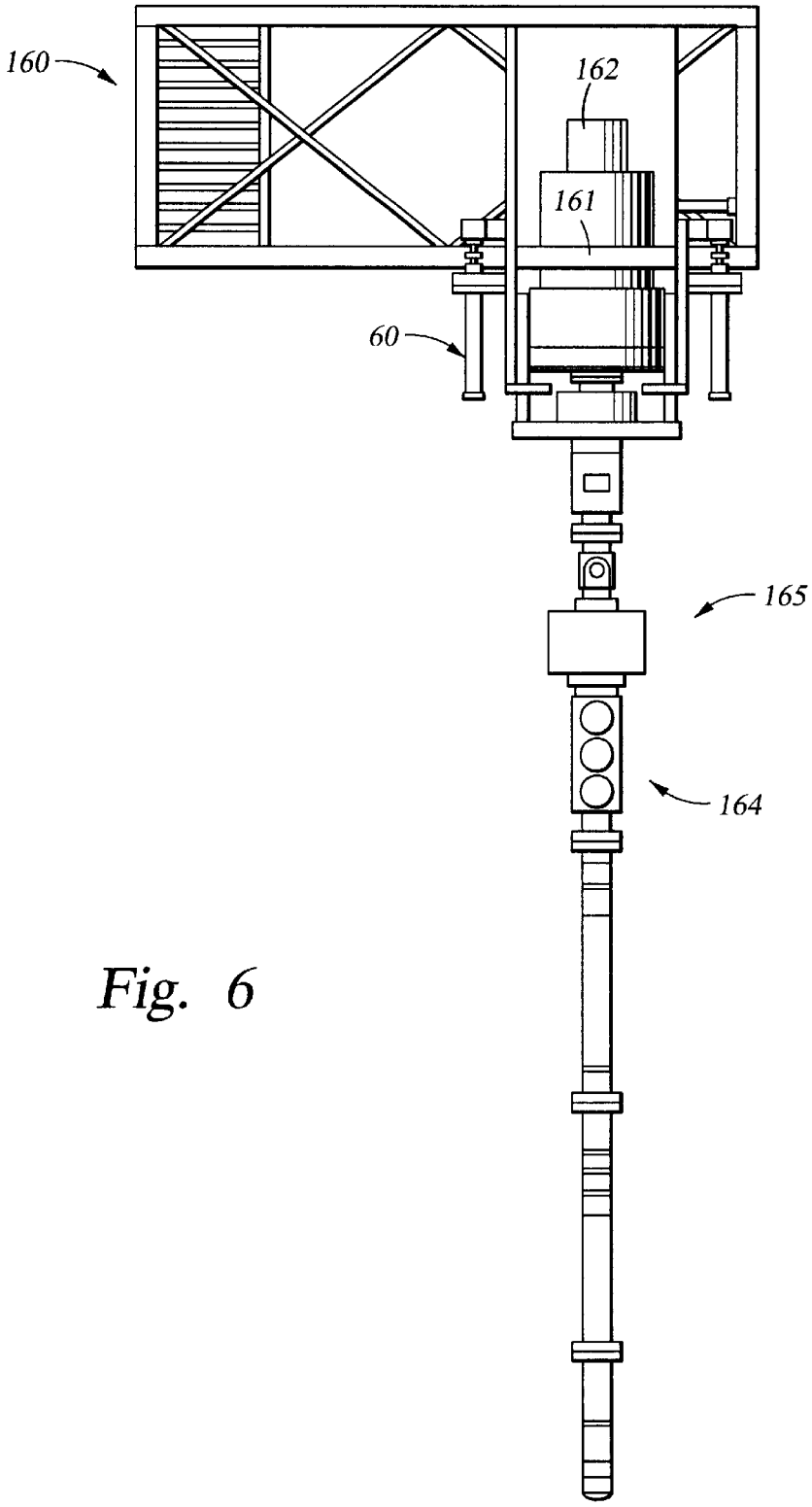
FIG. 6 illustrates an side view of a preferred injector module supporting a stack assembly.

Referring now to FIG. 6, injector module 160 includes a skid 161 that is adapted to support the injector stabilizer 60, an injector 162 and blowout preventer (BOP) stack 164. Injector 162 and BOP stack 164 will be collectively referred to as the "stack assembly" 165 (FIG. 6). Referring now to FIG. 6A, injector stabilizer 60. supports and provides for the vertical displacement of stack assembly 165 (FIG. 6). Injector stabilizer 60 includes a platform 62, a cage 64, a frame 65, and a plurality of lifts 66. Platform 62 is fixed to the injector skid 161 (shown in phantom and thus is stationary with respect to rig 30). Platform 62 engages cage 64 via lifts 66. Lifts 66 have a piston portion 66*a* connecting to platform 62 and a cylinder 66*b* connecting to frame 65. Cage 6*a* includes a plurality of vertical bars 64*a* provided with holes 64*b*. Frame 65 has a horizontal member 65*a* having holes 65*b* complementary to holes 64*b*. Dowels (not shown) lock cage 64 to frame 65 when inserted through aligned holes 65*b* and 64*b*. The vertical position of cage 64 relative to skid 161 can be varied by simply removing the dowels and re-positioning cage 64.

Figure 6B:
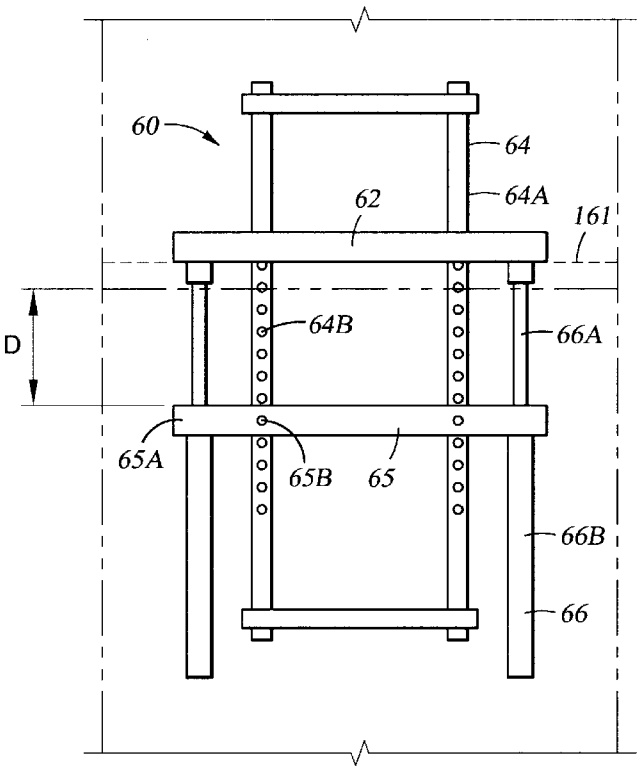
FIG. 6B illustrates a side view of a preferred stabilizer with the cage in a lowered position.
Figure 6A:
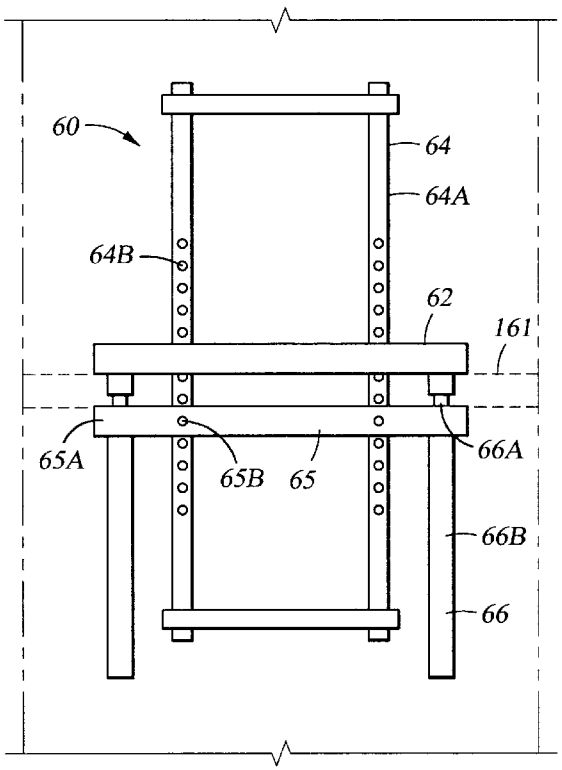
FIG. 6A illustrates a side view of a preferred stabilizer with the cage in a raised position.

Referring now to FIGS. 6A and 6B, the piston 66*a* and cylinder 66*b* of lifts 66 preferably employ a hydraulic piston-cylinder assembly to perform at least two functions. First, hydraulic lifts 66 can displace the stack assembly 165 vertically to accommodate the thermal expansion of the work string and stack assembly 165. That is, as stack assembly 165 expands due to exposure to the elevated temperatures of the produced fluids, lifts 66 allow the stack assembly 165 to rise vertically. Second, lifts 66 can vertically displace stack assembly 165 about 36 inches. FIG. 6A depicts the stabilizer cage 64 in a raised position whereas FIG. 6B depicts stabilizer cage 64 in its lower position, cage 64 having been lowered a distance D with respect to injector skid 161. Thus, after the connection between the BOP stack 164 and the wellhead assembly (not shown) is disconnected, lifts 66 can raise the stack assembly 165 off the wellhead assembly. It will be appreciated injector stabilizer 60 allows a complete stack assembly 165 to be moved without breaking the seals joining its individual components. Thus, considerable time which otherwise would be spent disassembling, assembling, and testing the BOP stack 164, is saved.

It will be understood that a hydraulic piston cylinder arrangement is one of many devices that may be satisfactorily accomplish the tasks described. For example, an arrangement utilizing springs may be used to accommodate the thermal expansion of stack assembly 165 and drive screws or worm gears coupled to an electric motor may be used to lift stack assembly 165. Platform 62 can optionally include means for variable angular positioning of the injector 162. For example, the positioning may be accommodated by a plate having a central hole and a plurality of elongated curved slots arrayed around the central hole. Stack assembly 165 (FIG. 6) can be fastened to platform 62 with threaded fasteners extending through the curved slots in the plate. Stack assembly 165 may then be rotated to any desired orientation by simply loosening the threaded fasteners.

Figure 7:
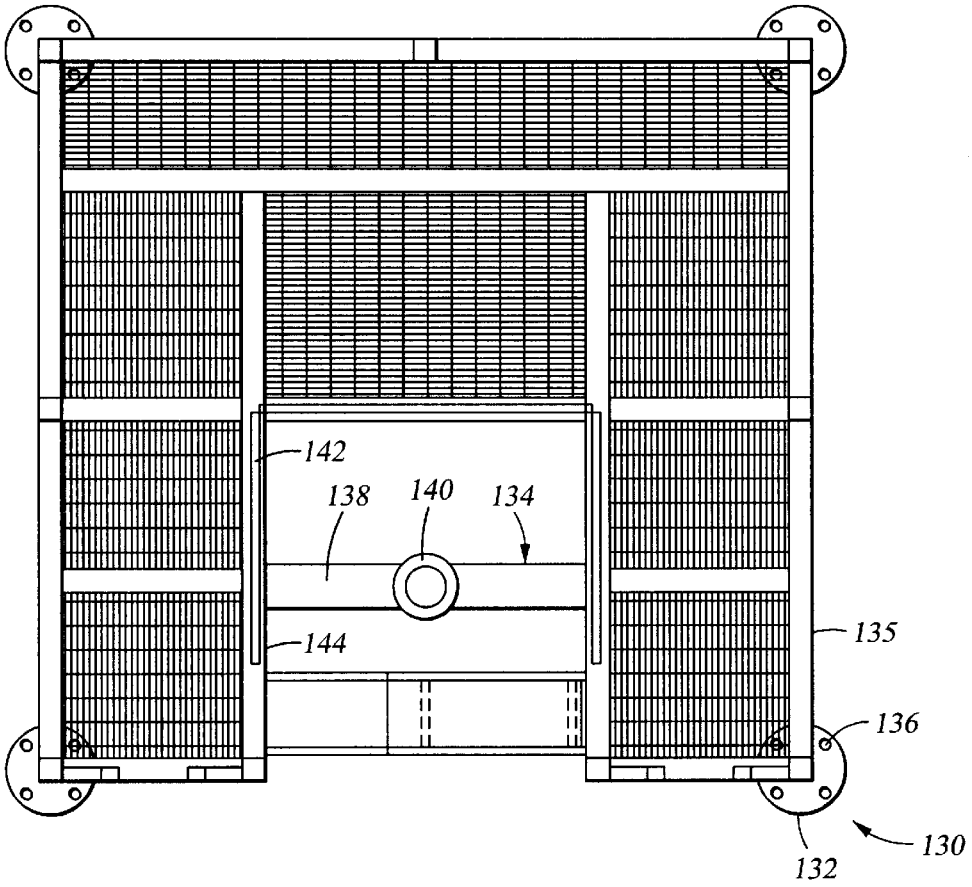
FIG. 7 illustrates a plan view of a preferred base module.

Referring now to FIG. 7, base module 130 acts as a foundation for preferred tower 40 (shown in FIG. 3). Base module 130 includes four corner pads 132 and a riser stabilizer 134. Corner pads 132 are welded or otherwise affixed to base module bottom frame 135 and include holes 136 sized to receive locking fasteners (not shown).

Referring now to FIGS. 2 and 7, a riser 31 extends from subsea wellhead assembly 33 to platform 32. Riser stabilizer 134 preferably includes a cross-bar 138 and split collar 140 for laterally supporting the upper end of riser 31. As is well known, risers can rise and fall due to ocean movement. Split collar 140 fits around the riser such that lateral movement of riser 31 is restricted. However, split collar 140 has enough radial clearance to allow riser 31 to slide up and down. Additionally, riser stabilizer 134 may be mounted on a skid 142 for movement in and out of a well area 144 of throat 102.

It should be appreciated that individual modules 100 can be adapted to accommodate many types of well equipment. With respect to coiled tubing applications, a coiled tubing guide 184, an injector 162, and a blowout preventer stack assembly 165 are among the most frequently used types of well equipment. Accordingly, the discussion above was directed to exemplary embodiments of modules adapted to support a coiled tubing guide, an injector, and blowout preventer stack. Nevertheless, it should be understood that the following is merely illustrative of the adaptability of tower 40.

Figure 8A:
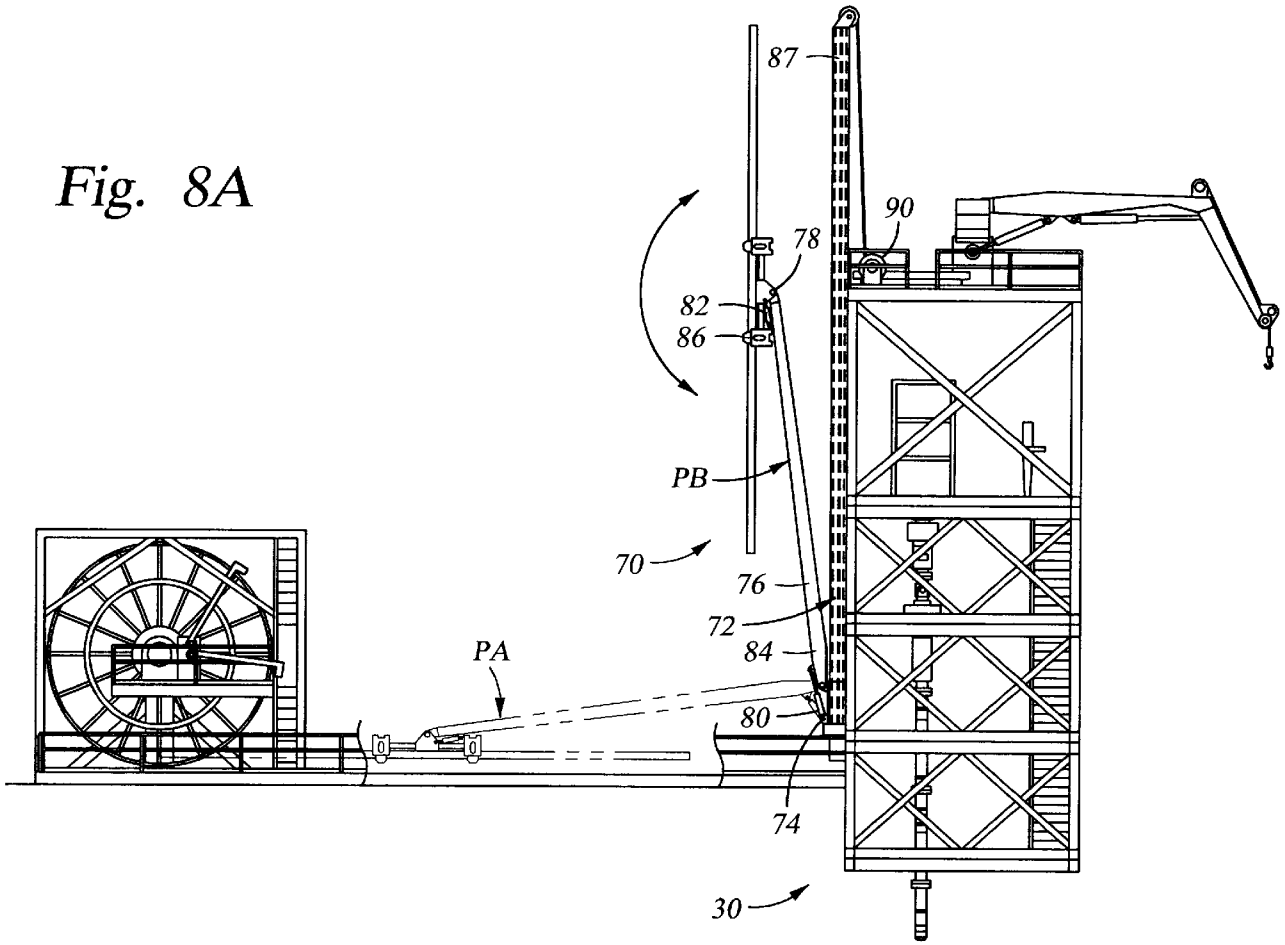
FIG. 8A illustrates a side view of powered arm gripping a CCT BHA segment.

Referring now to FIGS. 8A, B, and C, powered arm 70 is configured to transport BHA segments into and out of rig 30. Powered arm 70 includes a trolley 72, a base 74, a beam 76, a gripper 78, a first hydraulic piston 80, and a second hydraulic piston 82. Beam 76 is an elongated member having first and second ends 84, 86, respectively. Beam first end 84 connects to base 74 in a hinged fashion. First hydraulic piston 80 connects to beam 74 and base 72. When actuated, first hydraulic piston 80 pivots beam 74 from a substantial horizontal position PA to a substantially vertical position PB. Gripper 78 connects to beam second end 86 also in a hinged fashion. Second hydraulic piston 82 connects to gripper 78 and beam second end 86. When actuated, second hydraulic piston 82 pivots gripper 78 about beam second end 86. Gripper 78 and second end 86 presents opposing fingers that close to securely hold members such as BHA segments. The general design of robotic mechanisms are well known and will not be discussed in detail. The robotic systems utilized for the powered arm are well known in the prior art. Exemplary robotic devices and controllers are disclosed in U.S. Pat. Nos. 5,908,122, 5,816,736, 5,454,533, 4,178,632 and 4,645,084, all incorporated herein by reference.

Figure 8B:
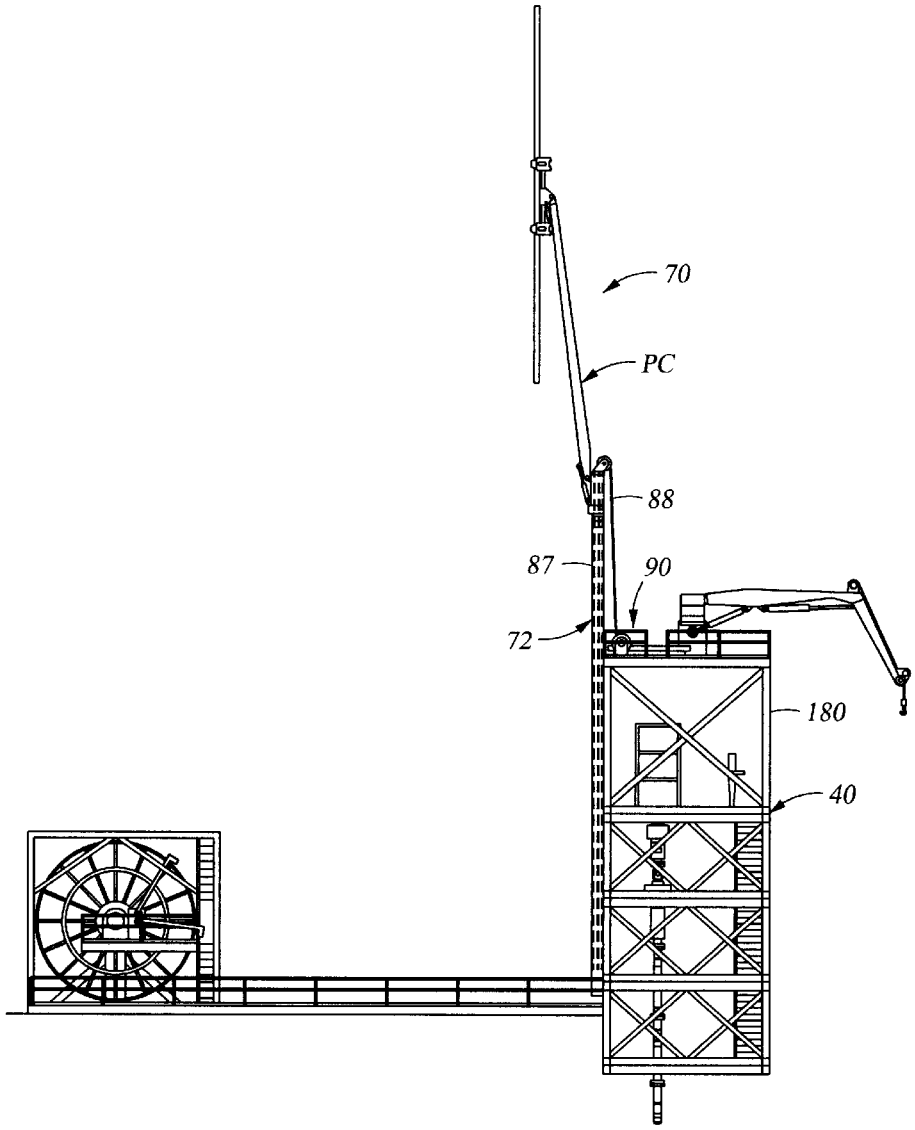
FIG. 8B illustrates a side view of powered arm holding a CCT BHA segment above the preferred rig.

Powered arm 70 is provided with three axes of movement. As shown in FIG. 8A, beam 76 of powered arm moves between a substantially horizontal position PA to a substantially vertical position PB through actuation of first hydraulic piston 80. As shown in FIGS. 8A and 8B, powered arm 70 moves between a first elevation proximate to base of tower 40 to a second elevation at a point PC above crown module 180 of tower 40. A trolley assembly 72 provides this translational vertical movement for powered arm 70. Trolley assembly 72 includes a track 87, a cable 88, and a winch 90. Powered arm base 74 slidingly engages track 87 and is connected to cable 88 extending from winch 90. As cable 88 is spooled onto winch 90, powered arm 70 is lifted along front face of tower 40.

Figure 8C:
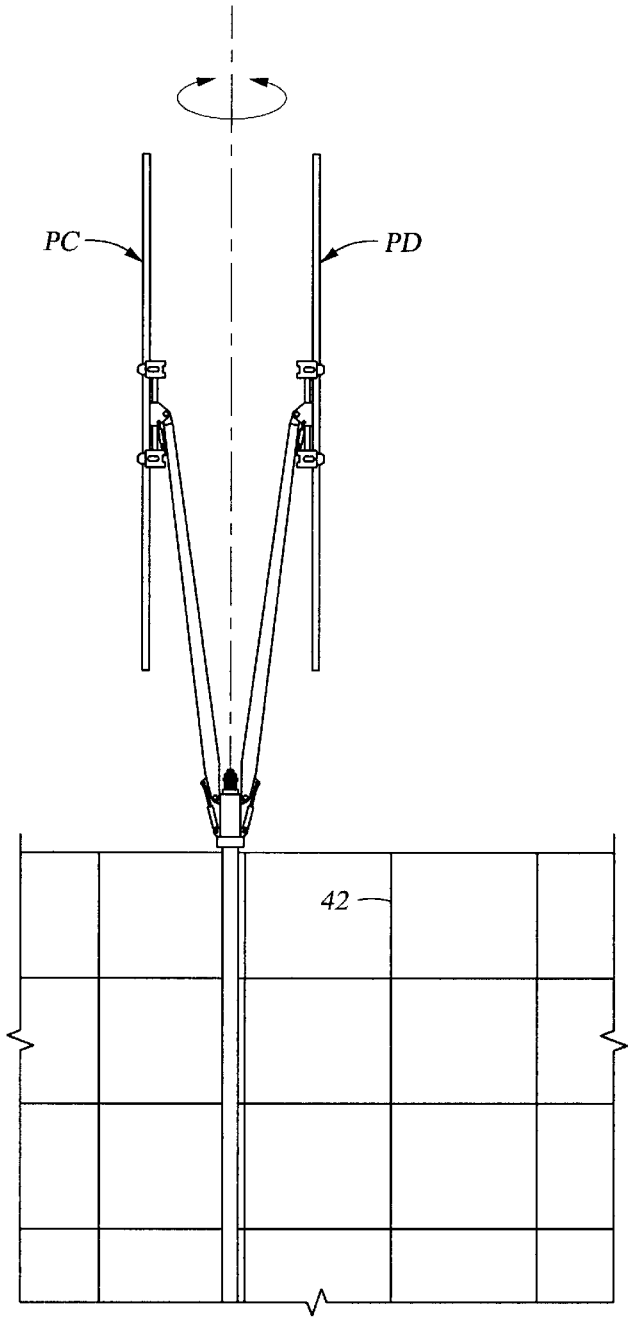
FIG. 8C illustrates a front view of powered arm positioning the CCT BHA segment over the injector.

Referring now to FIG. 8C, powered arm 70 also rotates about the longitudinal axis of track 87. An exemplary sweep may include a first position PC wherein powered arm 70 is in planar alignment with front face 104 of tower 40 and a second position PD wherein gripper 78 of powered arm 70 is above throat 102 of tower 40. Pivoting of powered arm base 74 may be enabled by any number of mechanical expedients, including a pintle-sleeve arrangement coupled to a geared electric drive (not shown). Preferably, powered arm 70 is controlled by a general purpose computer (not shown) that guides powered arm 70 through a predetermined sweep.

If required, a mousehole may be used to handle the CCT BHA segments. The mousehole is preferably a rigid elongated canister having a closed bottom and an open end for receiving the CCT BHA section. The open end may be closed with a removable cap. A lengthy CCT BHA often has inadequate axial rigidity to be safely handled by powered arm 70. Thus, by inserting the CCT BHA segments into a mousehole, the lifting and handling process is simplified. A rack (not shown) for holding the mousehole may be affixed fixed to tower 40.

Figure 9:
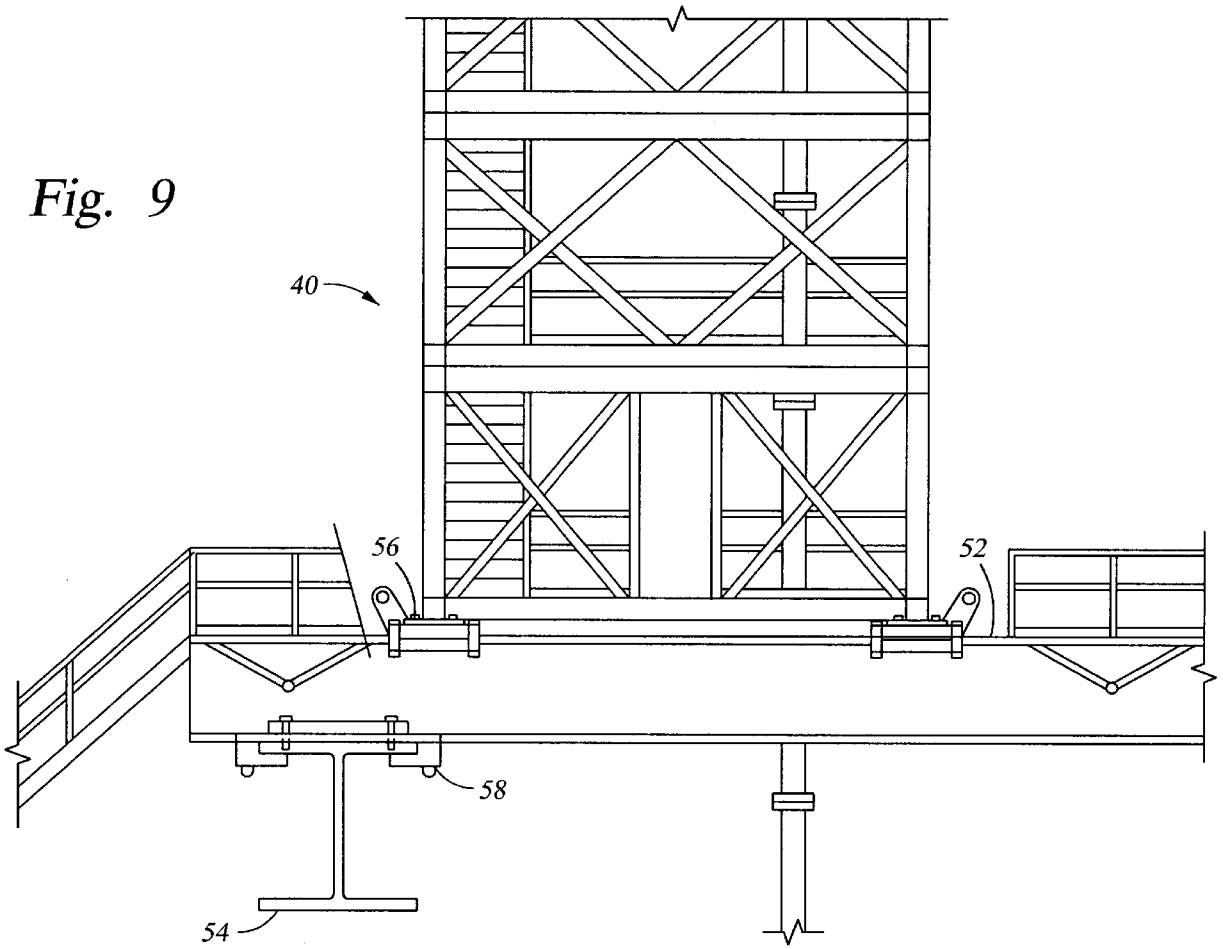
FIG. 9 illustrates a preferred arrangement of the skids for the preferred rig.

Referring to FIGS. 3 and 9, skids 50 allow rig 30 to be moved to any location within a two-dimension grid on platform 32. Skids 50 include a first set of rails 52 perpendicularly aligned to a second set of rails 54. First and second set of rails 52, 54 are preferably formed of "I" beams. Referring now to FIG. 9, tower 40 includes four outboard clamps 56 for engaging and riding on the first set of rails 52. Disengaging clamps 56 allows tower 40 to be slide along the X axis. A second set of clamps 58 join first and second set of rails 52, 54. Disengaging second set of clamps 56, allows first set of rails 52 and tower 40 to slide along the Y axis. The two-axis movement of tower 40 enhances the utility of tower 40 on platforms where space is limited. For example, in offshore platforms, a number of wells may be drilled from platform 52 in order to maximize hydrocarbon recovery from subsea reservoirs 34 shown in FIG. 2. Together with the other features of tower 40, skids 50 allow a fully constructed rig 30 to be moved to nearly any X-Y coordinate on platform 32. Thus, preferred rig 30 may be positioned at location A for servicing a well 36 intersecting formation F1, and later at position B for servicing well 38 intersecting formation F2 shown in FIG. 2. As can be seen, the need for multiple towers or the set-up and tear-down of individual towers, is minimized, particularly when servicing multiple wells.

The preferred rig 30 can be erected to cost-effectively meet the operational needs of a given platform, whether offshore or land-based. Use of the preferred rig 30 will be described in an exemplary situation where the well operator has decided to bypass certain hydrocarbon reserves during the initial well construction phase. Referring again to FIG. 2, a platform 32 has been erected to drill wells 36 and 38 to exploit large reservoirs F1, F2, respectively. Later, the well operator may wish to produce reserves F3 and F4 using a lateral well drilled with a CCT BHA. Initially, the modules 100 of the rig 30 are constructed per the platform requirement. For example, the height of the BOP stack 164 can vary depending on formation characteristics. By varying the number of intermediate modules 100, the preferred rig 30 can be constructed to the height that accommodates the BOP stack 164. Further, the skids 120 of the individual modules can be adapted, if need, to support a well operator's unique equipment. Thereafter, the individual rig components are shipped to the well site and assembled. The main platform crane will only be needed until the knuckleboom crane is installed on the crown module. Once the knuckleboom crane 186 is in operation, further tower construction can be performed autonomously. This tower construction is simplified by the open throat 102 of the tower 40, which allows side loading of well equipment into the tower 40. Moreover, the powered skids 120 supporting installed well equipment allows this equipment to be moved back near the back wall 106 of the modules 100 while personnel work in the well throat 102. The tower 40 can be reconfigured on-site, if necessary, to meet the changing needs of the well operator. Thus, the preferred tower 40 can be erected and brought into operation relatively quickly and inexpensively.

Once the preferred rig 30 is operational, the tower, components may be used to introduce CCT BHA segments and associated composite coiled tubing into the well. Preferably, the several segments of the CCT BHA 10 are collected at a staging area. The crown module skid 120, with its coiled tubing guide 184, is moved back to clear the area above the injector 162.

Referring generally to FIGS. 8A, 8B and 8C, in the position PA, the powered arm grips a first CCT BHA segment and initially brings the CCT BHA 10 into a vertical position PB at the base of the tower 40. Actuation of the winch 90 transports powered arm 70 and CCT BHA segment to position PC, a substantially vertical position above the tower 40. If the CCT BHA segment is enclosed in a mousehole, then the CCT BHA 10 is secured into a mousehole rack that is mounted on the front face 104 of the tower 40. Once the mousehole cap is removed, powered arm 70 can grasp the end of the exposed CCT BHA 10 and extract it out of the mousehole. The powered arm 70 then rotates to position PD to suspend the CCT BHA 10 over the tower 40, and preferably above the injector 162. Once alignment between the injector 162 and CCT BHA segment is checked, the powered arm 70 lowers the CCT BHA segment into the injector 162. Thereafter, the powered arm grips a second CCT BHA segment and repeats the movements as generally shown in FIGS. 8A, 8B and 8C. If two BHA sub-assemblies have a threaded connection, the power tong on the crown module 180 may be used to make-up the mating ends of the BHA segments. This process is repeated until a complete CCT BHA 10 is assembled and inserted to the injector 162. Thereafter, the composite coiled tubing is threaded through the coiled tubing guide 184 and the injector 162 and connected to the CCT BHA 10. If required, the coiled tubing guide 184 is oriented toward the coiled tubing reel. In later operations, the BOP stack 164 may be subjected to temperatures high enough to induce noticeable axial elongation. The injector stabilizer 60, if actuated, will vertically reposition the injector 162 and BOP stack 164 to accommodate the external elongation.

Once drilling and completion operation are finished for reserve F3, the well operator may decide to perform a similar operation for reservoir F4 through well 38. In this instance, the BOP stack connection is disconnected with the wellhead for well 38. Hydraulic lifts 66 for the injector stabilizer 60 are then actuated to lift the injector 162 and BOP stack 164 off of the wellhead 33. After other connections such as hydraulic and electrical lines are secured and tower equipment is stowed, the skid clamps 65, 58 can be loosened and the tower 40 moved into a grid location above well 38. Thus, servicing operations for well 38 can be initiated with minimal set up time.

It should be understood that the modular nature of the preferred rig 30 markedly enhances its useful service life. That is, once the servicing operations are concluded for a first platform, the preferred rig platform can be disassembled, transported to a second platform, and reassembled to the specific needs of the second platform. Moreover, the preferred rig 30 can be custom built to meet the need of each successive well operator without markedly affecting the utility of the other tower modules 100.

Preferred rig 30 is also particularly well adapted for automated operations. As described above, position sensors and video cameras are installed throughout preferred tower 40. Moreover, most of the well equipment such as the powered arm 70, the injector 162, module skids 120 and power tongs 187 may be remotely operated from a control cabin. Thus, once the CCT BHA 10 has been collared, the need for personnel presence on the tower 40 is minimized, if not entirely eliminated. Personnel can operate tower equipment and the BHA 10 from a control room located on the platform 32, or a control room in a geographically remote location. Furthermore, the teachings of the present invention may be used in conjunction with the invention disclosed in provisional application filed herewith, entitled "Self-Erecting Rig" which is incorporated by reference herein for all purposes.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An apparatus for conveying equipment from the base of a rig tower to the top of the tower, comprising:

a tower having a longitudinal axis;

a base affixed to the tower;

a beam having a first end pivotally connected to said base and a second end;

a first hydraulic member operatively engaging said beam and said base, said hydraulic member moving said beam from a first position to a second position when actuated; and a gripper pivotally connected to said beam second end, said gripper including a plurality of fingers having an open and closed position; and a hydraulic member associated with said fingers, said second hydraulic member moving said fingers between said open and closed positions.

2. The apparatus of claim 1 wherein said beam pivots between a substantially horizontal position and a substantial vertical position.

3. The apparatus of claim 2 wherein said beams swings substantially about an axis collinear with the longitudinal axis of the tower.

4. The apparatus of claim 3 wherein said beam swings from a first angular position to a second angular position.

5. The apparatus of claim 1 wherein said tower includes a vertical face and further comprising a trolley associated with said arm, said trolley adapted to move said arm along vertical face of said tower.

6. The apparatus of claim 5 wherein said trolley includes a track for receiving said base;

a winch mounted on said tower; and a cable having a first end connected to said base and a distal portion selectively spoolable on said winch.

7. The apparatus of claim 6 wherein said trolley transports said arm from a first vertical position to a second vertical position.

8. A method of introducing a bottom hole assembly segment into a stack assembly, comprising;

securing the segment onto an end of a movable arm;

lifting the segment to a position above the stack assembly; and lowering the segment into the stack assembly.

9. The method of claim 8 wherein the securing step is performed by opposing fingers provided on the end of the moveable arm.

10. The method of claim 8 wherein the lifting step includes rotating the arm from a substantially horizontal position to a substantially vertical position.

11. The method of claim 10 wherein the lifting step further includes substantially translational vertical movement of the arm.

12. The method of claim 8 wherein the movable arm is hydraulically actuated.

13. The method of claim 8 further comprising a step of controlling the arm using a general-purpose computer.

14. The method of claim 10 further comprising the steps of inserting the segment into a mousehole before securing the segment to the movable arm end;

securing the mousehole onto a rack at a location proximate to the top of the stack assembly; and extracting the segment out of the mousehole.

* * * * *